US005890346A

United States Patent [19]

Guess

[11] Patent Number: 5,890,346

[45] Date of Patent: Apr. 6, 1999

[54] DISC PACKAGING MACHINE AND METHOD

[75] Inventor: Larry C. Guess, Palmyra, Wis.

[73] Assignee: Automated Packaging Systems, Inc., Streetsboro, Ohio

[21] Appl. No.: 802,479

[22] Filed: Feb. 20, 1997

[51] Int. Cl.[6] ..... B65B 43/12

[52] U.S. Cl. ..... 53/459; 53/570; 414/797; 414/908

[58] Field of Search ..... 414/27, 737, 795.8, 414/798.9, 908, 223, 797; 53/254, 570, 385.1, 386.1, 284.7, 571, 409, 459; 221/103, 105, 211

[56] References Cited

U.S. PATENT DOCUMENTS

| | | | |
|---|---|---|---|
| 4,589,811 | 5/1986 | Riccardo | 414/224 |
| 4,614,075 | 9/1986 | Focke | 53/168 |
| 4,645,401 | 2/1987 | Hopkins | 414/222 |
| 4,695,007 | 9/1987 | Muto | 242/58.4 |
| 4,758,126 | 7/1988 | Johnson | 414/330 |
| 5,031,381 | 7/1991 | Focke | 53/398.1 |
| 5,165,340 | 11/1992 | Karlyn | 101/126 |
| 5,274,984 | 1/1994 | Fukuda | 53/451 |
| 5,394,676 | 3/1995 | Lerner | 53/459 |
| 5,470,195 | 11/1995 | Blank | 414/797 |
| 5,549,444 | 8/1996 | Dubuit | 414/796.7 |
| 5,561,962 | 10/1996 | Everhard | 53/55 |
| 5,640,834 | 6/1997 | Lerner | 53/459 |
| 5,692,878 | 12/1997 | Freund | 414/796.6 |
| 5,709,069 | 1/1998 | Cronauer | 53/459 |

*Primary Examiner*—Daniel B. Moon
*Assistant Examiner*—James P. Calve
*Attorney, Agent, or Firm*—Watts, Hoffmann, Fisher & Heinke Co., L.P.A.

[57] ABSTRACT

A compact disc (CD) dispenser mounted on a bagging machine is disclosed. The dispenser includes turret and transfer assemblies. The turret assembly includes an indexing system to sequentially and one at a time position mandrels carrying CD disc sets at a dispensing location. The transfer assembly includes a pair of pickup heads driven by the rotary actuator. The pickup heads are adapted sequentially and one at a time to remove discs from a set positioned at the dispensing location and after 180° rotation of the fluid actuator, drop a picked up disc into a waiting bag in the bagging machine.

20 Claims, 9 Drawing Sheets

DISC PACKAGING MACHINE AND METHOD

This invention relates to packaging and more particularly to a novel and improved method and apparatus for packaging annular discs.

BACKGROUND OF THE INVENTION

Compact discs, now known simply as "CD's" frequently are individually packaged in cardboard, envelope like, containers. On other occasions the packaging is more sophisticated utilizing such things as hinged plastic enclosures with a CD positioning insert.

Clear plastic films are now widely utilized in packaging. Such packages are advantageous for many applications because their clarity permits visual inspection of the contents, the plastics are readily printable and they are inexpensive. While plastic film packages have enjoyed popularity, they have not been used for packaging thin disc products such as CD's, primarily because there has been no effective inexpensive method and apparatus for packaging them. Accordingly, it would be advantageous if there existed an efficient and inexpensive method and apparatus for providing individual plastic packages for CD's.

SUMMARY OF THE INVENTION

The machine of the present invention utilizes a bagging machine sold by the assignee of this patent under the designation H-100 Excel. The current machine, while somewhat modified and improved, is nonetheless essentially the machine described and claimed in U.S. Pat. No. 5,394,676, issued May 7, 1995, under the title Packaging Machine and Method (here the Excel Patent). The Excel Patent is incorporated by reference in its entirety.

A CD dispenser is mounted atop the Excel machine. The dispenser includes a frame secured to the Excel machine. Turret and transfer assemblies are mounted on the frame in spaced relationship.

The turret assembly has a turret equipped with a plurality of, preferably six, circumferentially spaced parallel mandrels. Each of the mandrels is adapted to support a set of CD's to be individually dispensed and packaged. The turret is rotatable to index the mandrels sequentially and one at a time into a dispensing location.

The turret assembly includes a pusher for advancing a set of discs outwardly along a mandrel in the dispensing location. The pusher serves to sequentially cause each of the discs of a set to be an end disc positioned for pickup by the transfer assembly.

The transfer assembly has a rotatable hub which carries a pair of diametrically opposed arms. Each arm has a vacuum pickup head at its end. The hub is rotatable through 180° of travel alternately in clockwise and counter clockwise directions to shift the pickups between a pickup position and a disc release position.

A cam is reciprocatably mounted at a location near the pickup station. The cam is effective to move an arm registered in its pickup position into engagement with an end disc of a set at the dispensing location and then to release the arm for spring biased return to a disc transfer position.

The transfer assembly also includes a pair of friction elements positioned on opposite sides of a set of discs at the dispensing location for frictionally engaging a number of discs. The friction elements are effective to retain discs other than the end disc on the mandrel at the dispensing location as the end disc is removed by one of the pickups.

The transfer assembly also includes a pair of proximity switches, each associated with one of the transfer arms. When a transfer arm approaches the disc release position, its associated proximity switch emits a signal. The vacuum holding the disc to be discharged is temporarily terminated in response to the signal and a short blast of air is discharged from the arm to separate the disc from the arm.

Once a disc is released from the transfer assembly, it drops into a positioned, open bag at a load station on the Excel Machine. The load station is a novel and improved load station as described and claimed more fully in a concurrently filed application entitled Packaging Machine and Method, now U.S. Pat. No. 5,709,069, issued Jan. 20, 1998 (the Load Station Patent). The Load Station Patent is incorporated by reference in its entirety.

A prime mover is operably interposed between and connected to the turret and transfer assemblies. When a set of discs have been removed from a mandrel, the prime mover relatively moves the assemblies away from one another. Once the assemblies are sufficiently separated, the turret is rotated to index another of the mandrels carrying a complete set of discs into the dispensing location.

Each of the discs has a recording face and a back. The disc recording face is quite delicate and should not be touched. Accordingly, when a set of discs are mounted on a mandrel, they are mounted with the faces oriented towards the base of the mandrel and the backs outwardly.

In order to assure appropriate orientation of the discs, back side out on the mandrels, to minimize costs and to optimize the packaging capacity of the system, the mandrels are removably mounted on the turret. When all of the CD's carried by a set of mandrels on the turret have been dispensed, the emptied mandrels are removed and a replacement set of mandrels, each carrying a new set of discs are mounted on the turret.

In order to minimize error in the orientation of the discs on the mandrels and again for the sake of efficiency, the mandrels are automatically machine loaded with discs each having their backs outwardly facing for pickup by the pickup heads. Further, should it happen that the discs are somehow mounted face side out, the vacuum pickups will not effectively hold the discs, thus providing a warning to the operator that something is amiss, so that the machine will be stopped and the operator can take remedial steps to provide appropriately oriented discs.

Accordingly, the objects of the invention are to provide a novel and improved method and apparatus for packaging discs in individual plastic bags.

DETAILED DESCRIPTION

Figure 1:
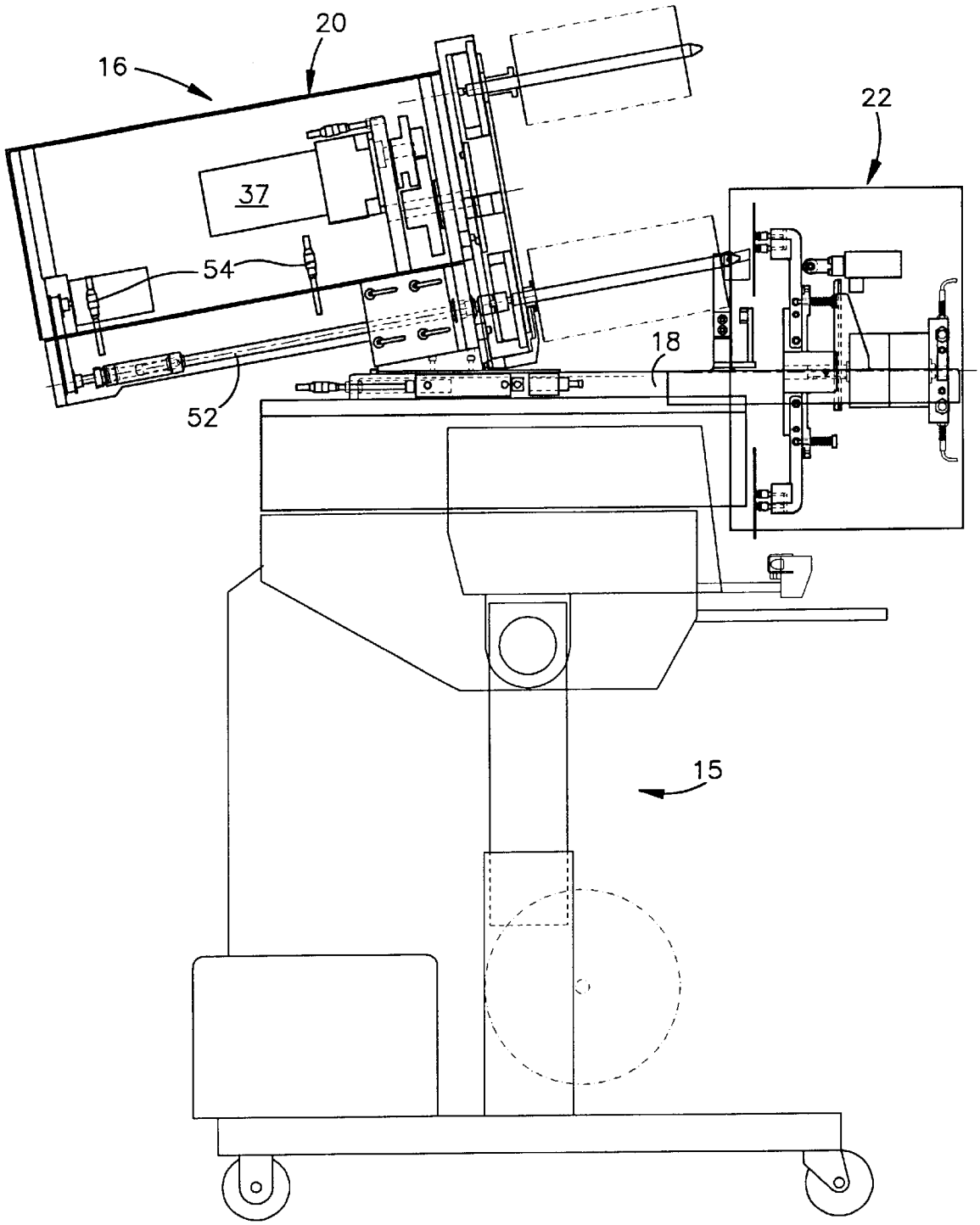
FIG. 1 is a side elevational view of the machine of this invention.
Figure 2:
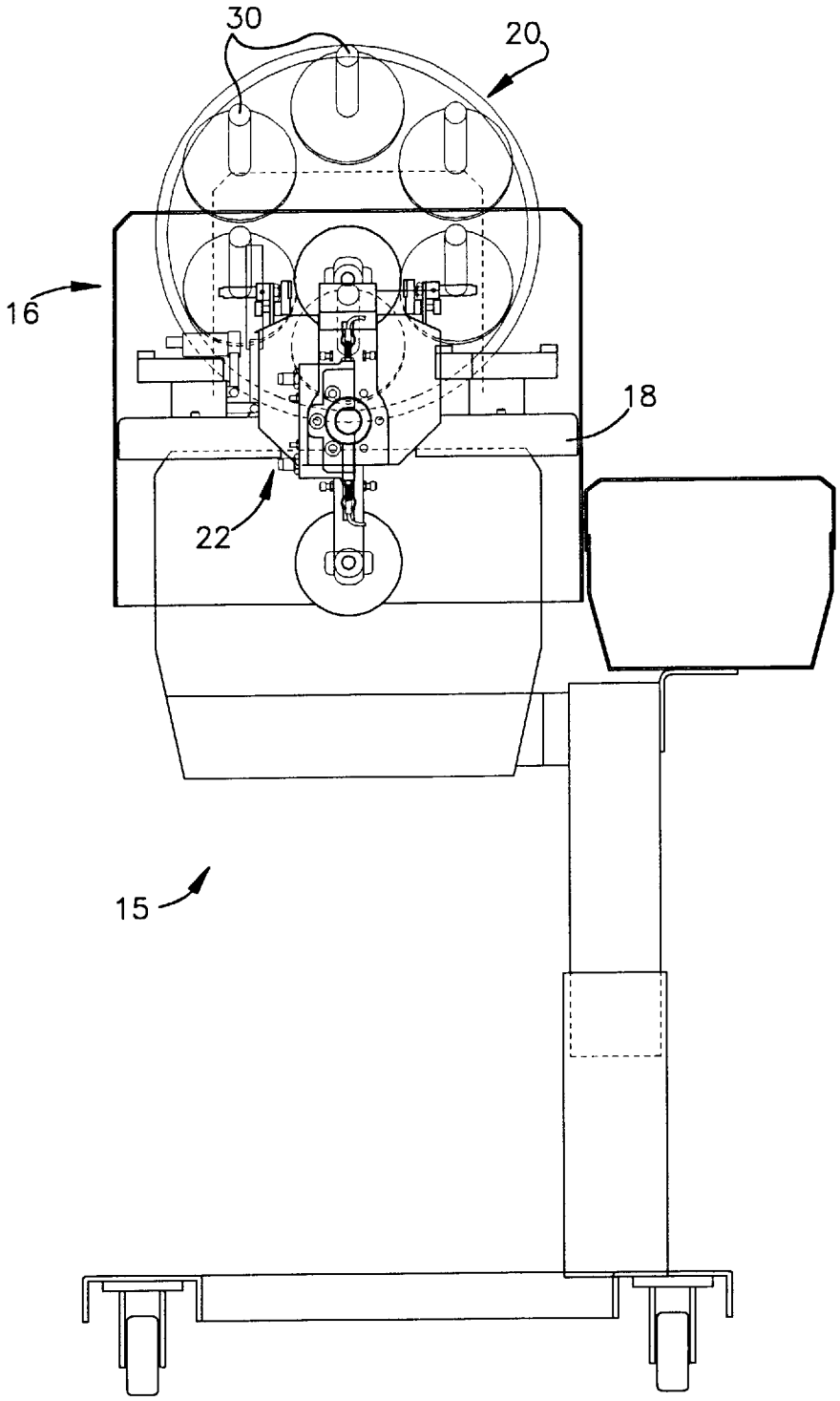
FIG. 2 is a front elevation view of the machine of this invention.

Referring to the drawings and to FIGS. 1 and 2 in particular, a packaging machine 15 of the type described more fully in the referenced Excel Patent and the Load Station Patent is shown generally at 15. A CD dispenser 16 is mounted atop the packaging machine 15. The dispenser 16 includes a base frame 18 secured to the packaging machine 15. Turret and transfer assemblies 20,22 are carried by the base frame 18 to complete the dispenser 16.

The Turret Assembly 20

Figure 3:
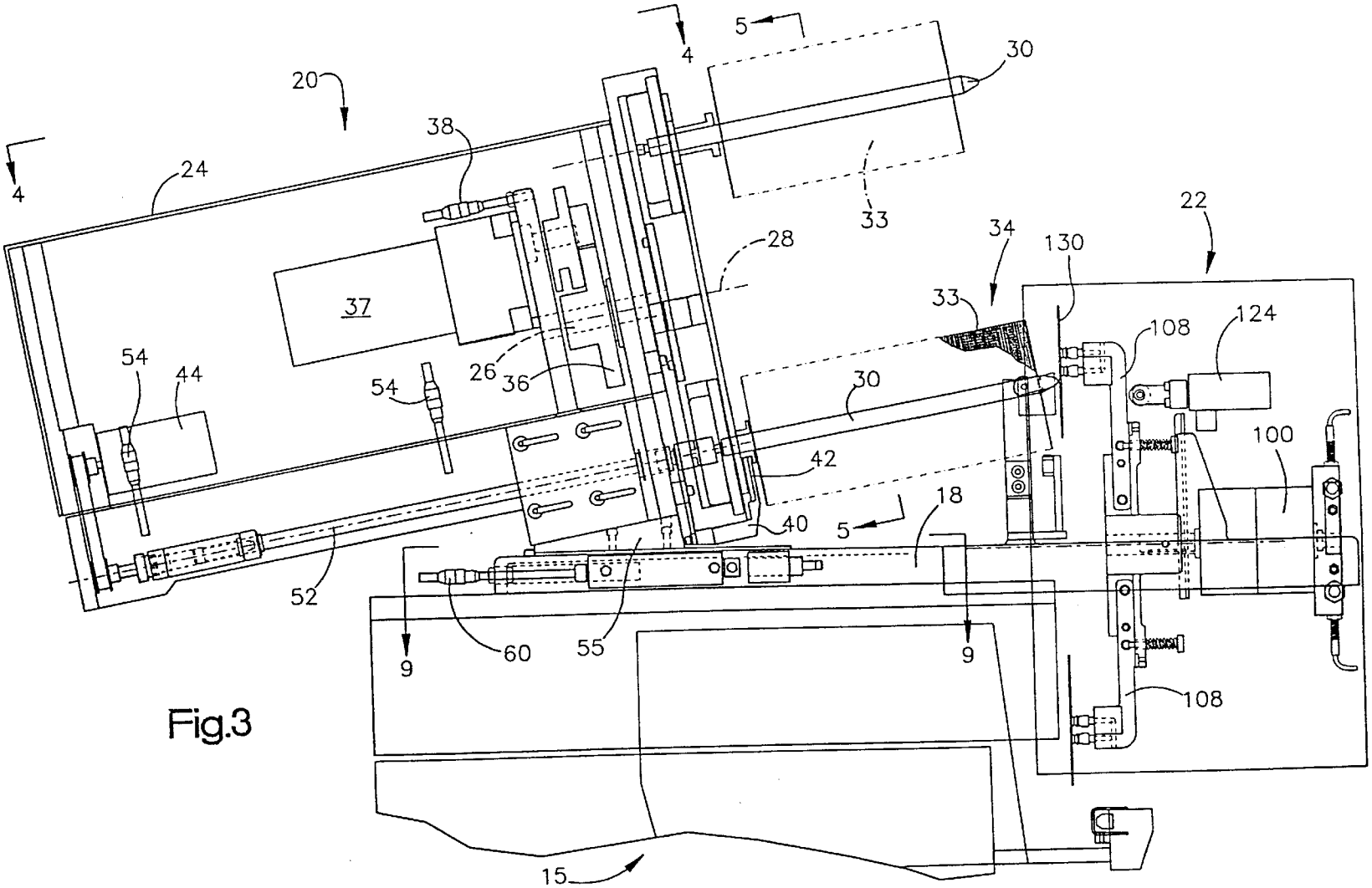
FIG. 3 is an enlarged, partially sectioned view of the novel transfer and turret assemblies.
Figure 4:
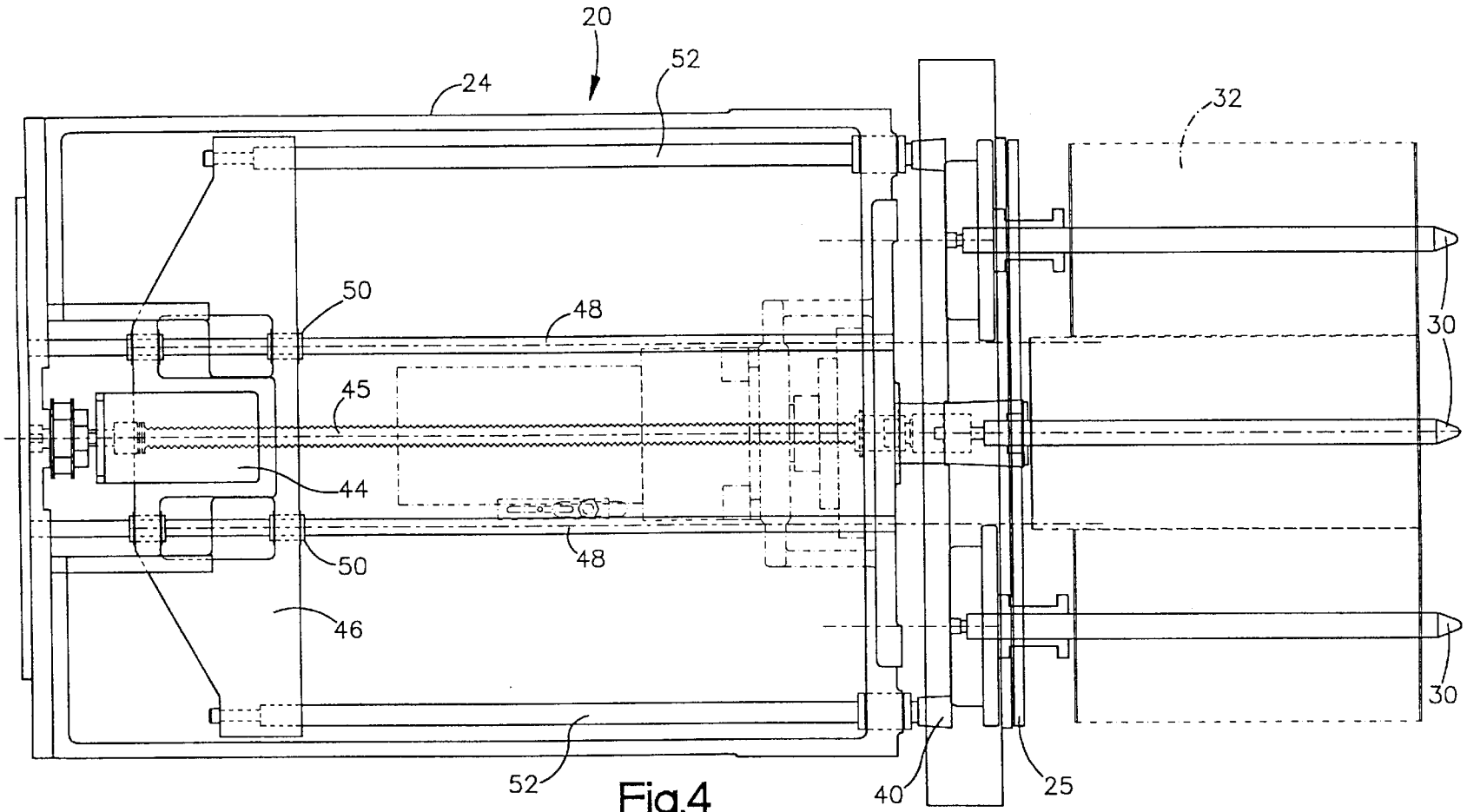
FIG. 4 is a top plan view, with parts broken away and removed, of the turret assembly on the scale of FIG. 3 and as seen from the plane indicated by the line 4—4 of FIG. 3.
Figure 5:
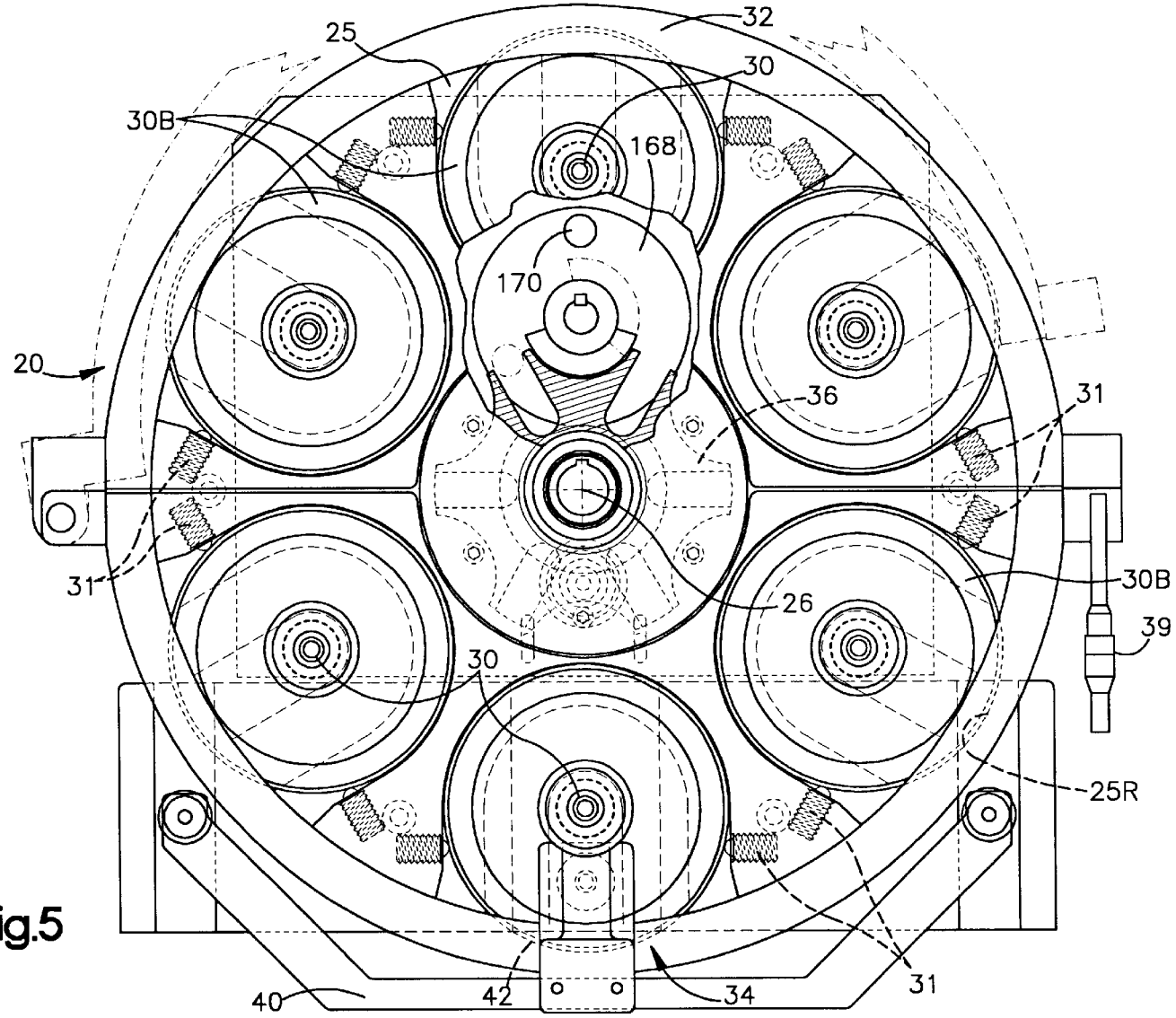
FIG. 5 is an enlarged, front elevational view of the turret assembly as seen from the plane indicated by the line 5—5 of FIG. 3.

The turret assembly is best shown in FIGS. 3–5. The assembly 20 inlcudes a housing and frame 24. As is best seen in FIG. 3, a turret 25 is mounted on a shaft 26 for rotation about an axis 28. The turret assembly 20 is canted rearwardly and downwardly such that the axis 28 is at about 10° with the horizontal and a forward extension of the axis passes over the transfer assembly 22.

A set of six circumferentially spaced, removable mandrels 30 which project orthogonally from the turret 25. Each mandrel has an axis paralleling the turret axis 28. As shown in FIG. 5, each removable mandrel is maintained in position by a pair of detents 31 and a split collar 32. The split collar overlies portions of bases 30B of the mandrels. The bases 30B are disposed in respective recesses 25R in the turret 25.

For clarity of illustration only two of the mandrels 30 are shown in FIG. 3. As indicated in FIG. 3, each of the mandrels is adapted to carry a set of compact discs 33. The turret is adapted to be indexed to bring the mandrels sequentially and one at a time into a dispensing location 34. As is best seen in FIG. 5, the mandrel 30 in the dispensing location 34 has its axis in a vertical plane which includes the rotational axis 28. Further, the mandrel in the dispensing location is the lowermost of the six mandrels.

Indexing of the turret 25 and the mandrels 30 is accomplished with Geneva motion. A star wheel 36 for effecting the Geneva motion is best seen in FIG. 5. As is seen from an examination of FIG. 3, the star wheel 36 is mounted on the shaft 26. An indexing motor 37 is operatively connected to the Geneva motion mechanism for selectively causing indexing rotation of the turret 25. An indexing control proximity switch 38, FIG. 3, senses when the motor 37 has completed an indexing revolution and thereby completed a Geneva motion cycle. As shown in FIG. 5, another proximity switch 39 senses whether the split collar 32 is open for mandrel mounting or removal as shown in phantom or closed for turret operation as shown in solid lines, FIG. 5. The split collar switch 39 prevents operation of the indexing motor 37 unless the collar is closed.

A CD raising or biasing bar 40 is provided. The bar 40 carries upstanding fingers 42 which extend upwardly from the bar in a location behind a set of CD's 33 on the mandrel at the dispensing location 34. As the CD's are dispensed from the set at the dispensing location, the raising bar 40 is advanced, left to right as viewed in FIGS. 3 and 4, incrementally to function as a pusher and maintain successive end discs in appropriate registration for transfer by the transfer assembly 22.

A raising bar motor 44 is positioned to the rear of the turret assembly 20, the left as viewed in FIGS. 3 and 4. The motor 44 is drivingly connected to a lead screw 45. The lead screw 45 is in driving engagement with a cross bar 46. The cross bar 46 is journaled on guide rods 48 by lineal bushings 50. The cross bar 46 is connected to the raising bar 40 by push rods 52. Actuation of the reversible raising bar motor 44 causes rotation on the lead screw 45 which in turn shifts the raising bar 40 due to its interconnection with the lead screw via the cross bar 46. Proximity switches 54, FIG. 3, are positioned to emit reversing signals to the motor 44 whenever the raising bar 40 reaches an extreme of its travel.

Figure 9:
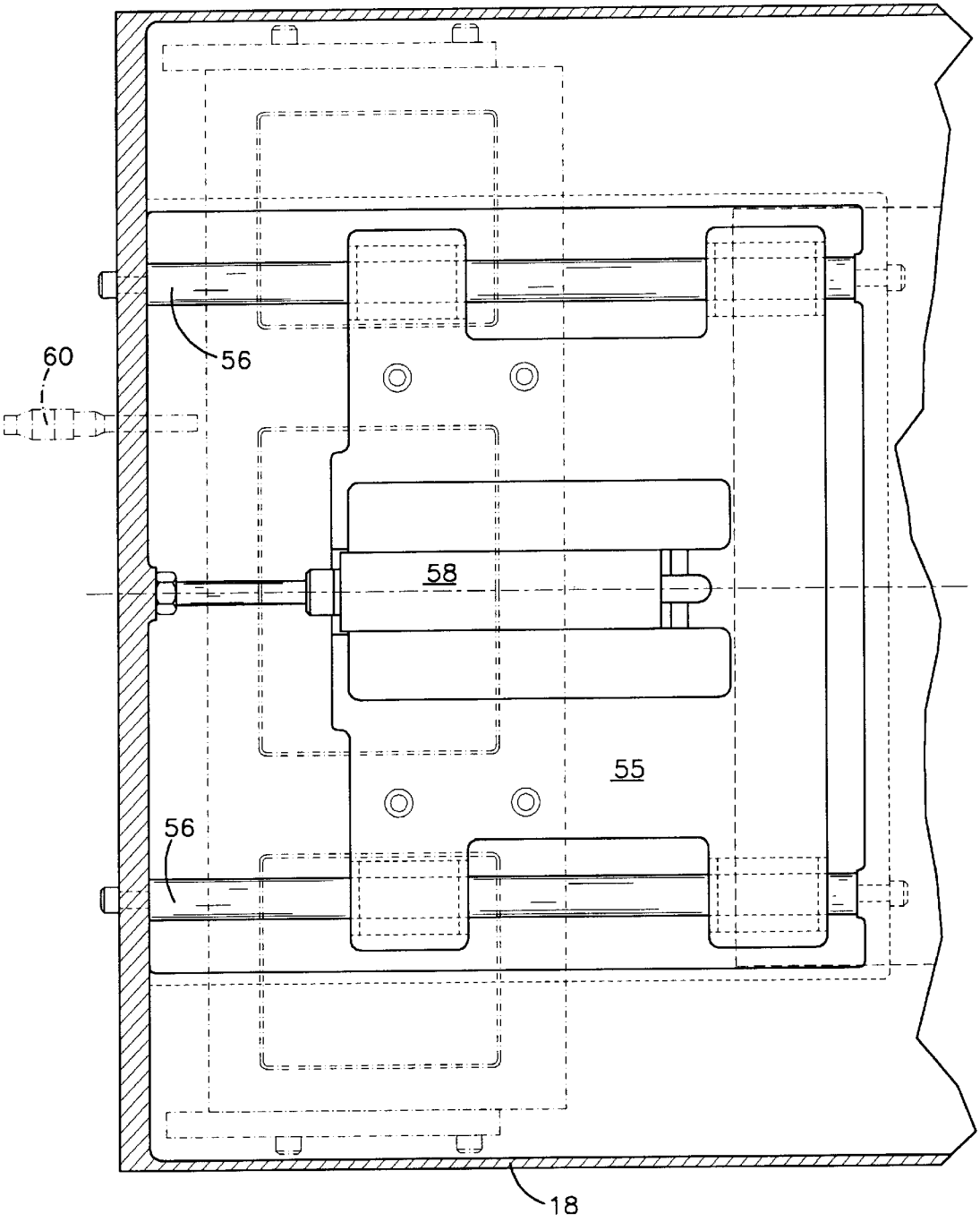

When the turret 25 is to be indexed to bring a different mandrel and a fresh set of CD's into the dispensing location 34, it is necessary to increase the relative spacing between the turret and transfer assemblies 20, 22. To this end the transfer assembly housing and frame 24 is mounted on a support frame 55, FIGS. 3 and 9. The support frame 55 in turn is mounted on slide shafts 56 supported by the base frame 18. An air cylinder 58 is interposed between the base and support frames 18, 55 for shifting the turret assembly 20 away from the transfer assembly 22, to the left as viewed in FIGS. 1 and 3, to a retracted position enabling indexing of the turret. A turret assembly position sensing proximity switch 60 senses rearward travel of the turret assembly 20, FIG. 9. The assembly switch 60 disables the indexing motor 37 unless the assembly 20 is in its retracted position.

The Transfer Assembly 22

Figure 6A:
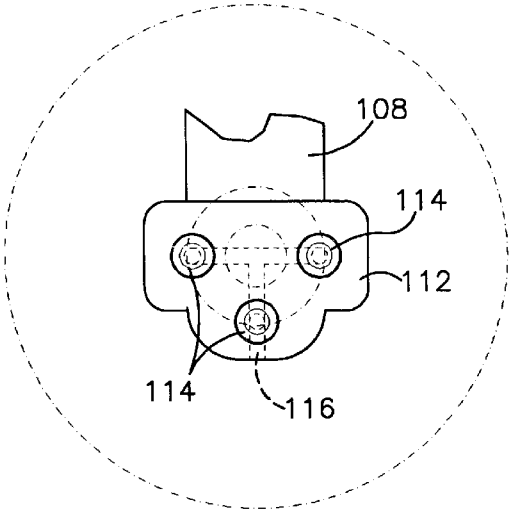
FIG. 6A is an enlarged view of a disc pickup head as seen from the plane indicated by the line 6A—6A of FIG. 6.
Figure 6:
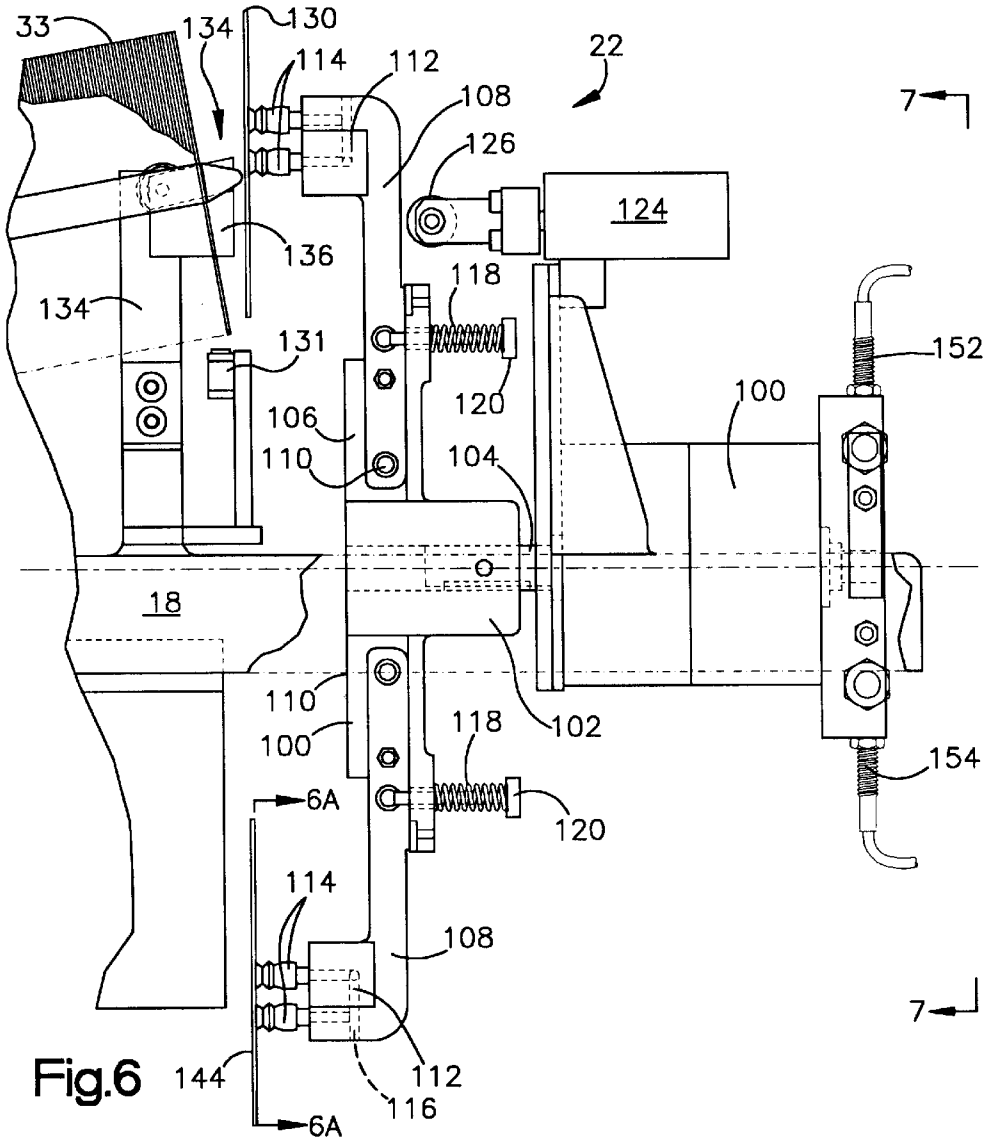
FIG. 6 is an enlarged side elevational view of the transfer assembly.
Figure 8:
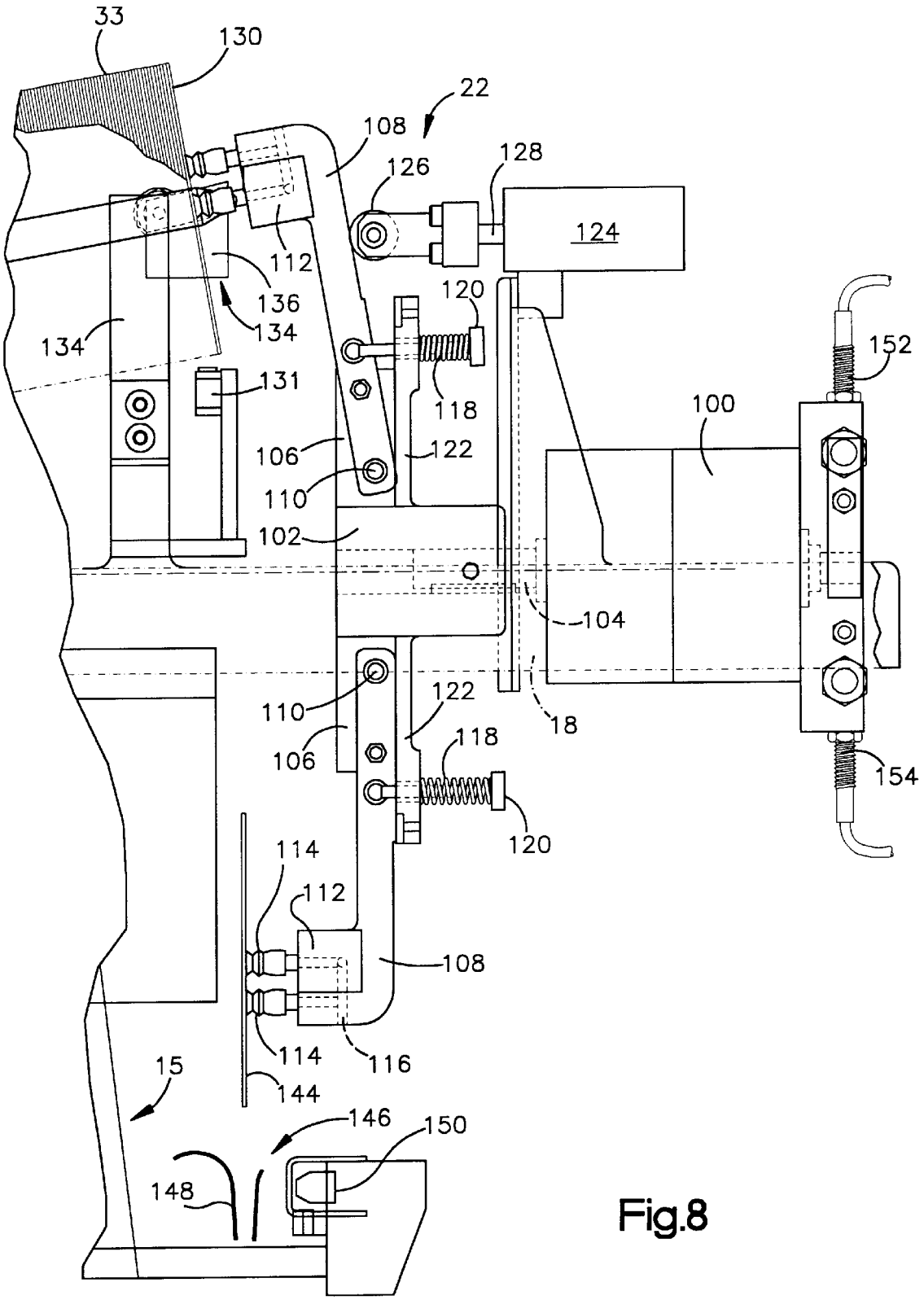
FIG. 8 is a view corresponding to FIG. 6, but showing one of the arms biased into a disc pickup position; and, FIG. 9 is an enlarged cross-sectional view of the base frame and turret assembly support.

The transfer assembly 22 includes a rotary fluid actuator 100 which is connected to and supported by the base frame 18, FIGS. 6 and 8. A hub 102 is mounted on an output shaft 104 of the actuator 100. The hub 102 has a diametrically opposed pair of arm support projections 106. A pair of pickup arms 108 are respectively pivotally connected to the projections 106 by pivots 110. Each of the pickup arms 108 carries an associated head 112. Each head includes a set of three pickup cups 114, FIG. 6B. The three cups are each connected to a T-shaped fluid passage 116 formed on the associated head 112.

A pair of arm biasing springs 118 are provided. Each of the springs 118 surrounds the shank of a headed bolt 120. The bolts respectively pass through apertures in shoulders 122 of the projections 106. The bolts 120 are respectively threadedly connected to the arms 108 such that the springs 118 normally bias the pickup arms 108 against the shoulders 122.

An arm positioning cylinder 124 is connected to the frame 18 and mounted above the motor 100. A roller cam 126 is mounted on a piston rod 128 of the cylinder 124. Referring to FIG. 8, when an upper one of the arms 108 is positioned for taking an appropriately positioned end one 130 of the disc set 33, the cylinder 124 is energized. The cylinder drives the cam 126 against the upper arm 108, pushing it from the position shown in FIGS. 3 and 6 to the pickup position of FIG. 8. This pivoting of the upper arm is against the action of the upper one of the springs 118. Once vacuum supplied through the passage 116 to the cups 114 has secured the end disc 130 to the cups, the cylinder 124 is returned to its retracted position of FIG. 6 and the arm is returned to a radially disposed position of FIGS. 3 and 6 by the action of the spring 118.

An electric eye 131 is mounted on the frame 18 and positioned to sense the presence of an end disc 130 positioned appropriately for pickup, FIGS. 6 and 8. When a disc set 33 has been completely removed from a mandrel at the dispensing location 34, a signal from the eye 131 disables the actuator 100 and initiates a turret indexing cycle.

Discs of the set 33 tend to stick together due to surface tension. In order to insure that only the end disc 130 of a set 33 is picked up, a pair of friction assemblies 132, 134 are provided, FIG. 7. Since the friction assemblies are mirror images of one another, only the assembly 134 will be described in detail. The assembly 134 is shown in front elevational view in FIG. 7 and in side elevational view in each of FIGS. 6 and 8. The assembly 134 includes a friction element 136 which engages perimetral surfaces of discs of the set 33 at the dispensing location 34. The assembly 134 includes an air cylinder 138 connected to the frame 18 by a support 140. A piston rod of the cylinder 138 carries the friction element 136 and transfers biasing pressure from the cylinder 138 to the friction element 136.

Once the end disc 130 has been picked up the pickup actuator 100 is energized to rotate the hub 102 through 180° such that the end disc 130 becomes a transferred disc 144. As is seen in FIG. 8, the transferred disc 144 is immediately above a load station 146 of the packaging machine 15. When a bag 148 is appropriately positioned and open at the load station 146, the vacuum drawing the transferred disc 144 against the cup 114 is terminated and a short puff or blast of air under pressure is delivered to the fluid passage 116. This air puff positively separates the transferred disc 144 from the cups 114 so that the disc 144 will drop into the bag 148. The bag is thereafter sealed by a sealer 150, all of which is described more fully in the Load Station Patent.

A pair of transfer mechanism proximity switches 152, 154 are provided. The transfer switches 152, 154 are secured to a switch bracket 156 connected to the frame 18. The proximity switches 152, 154 function to control the provision of vacuum and air to the cups 114 in response to sensed positions of the actuator 100.

Figure 7:
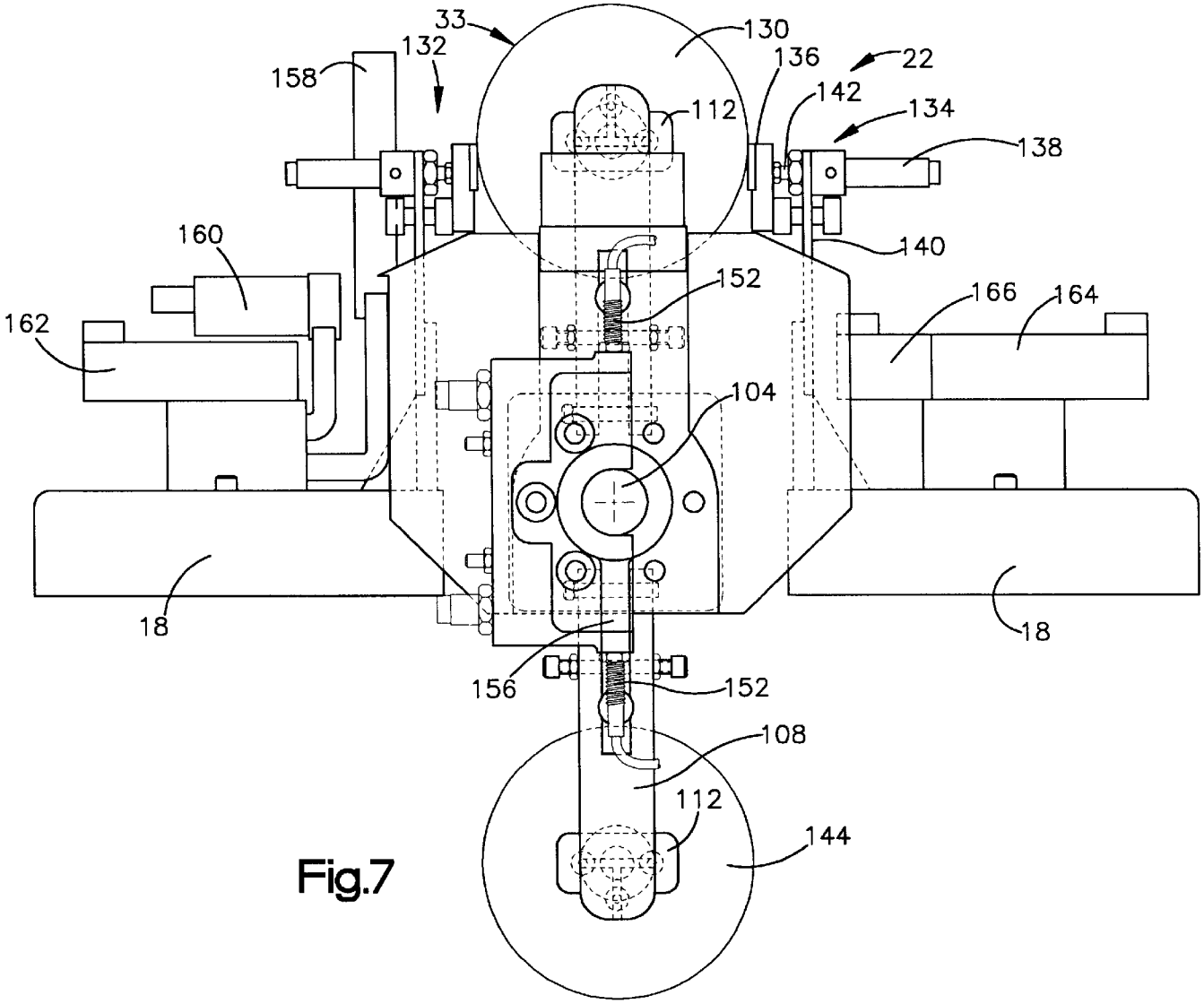
FIG. 7 is a front elevational view of the transfer assembly as seen from the plane indicated by the line 7—7 of FIG. 6.

Referring now to FIG. 7, vacuum and air supplies 158, 160 are provided. The supplies are connected to a four way solenoid valve 162. The four way valve is in turn connected, through conduits not shown, to the pickup heads 112. The four way solenoid valve 162 controls the supply of vacuum and air under pressure to the pickup heads 112 in response to signals received from the transfer switches 152, 154.

To the right as viewed in FIG. 7, two additional four way solenoids 164, 166 are supported by the frame 18. Each of the solenoids 164, 166 is connected to the air pressure supply 160. The solenoid 164 is a pickup solenoid which controls the operation of the arm positioning cylinder 124. The solenoid 166 is an actuator control solenoid connected to the rotary actuator 100 to control its opposite 180° rotations between the disc pickup and disc delivery positions.

Operation of the Machine

The first step in setting the machine up for operation is to energize the retraction air cylinder 58 to move the turret assembly 20 rearwardly and provide adequate clearance between the turret and transfer assemblies 20, 22.

Next, the split ring 32 is opened and any and all mandrels without disc sets 33 on them that are in the machine, are removed from the turret 25 at this juncture. Next six mandrels 30 loaded with back side out disc sets 33 are mounted on the turret 25 by placing a mandrel base 30B in each turret recess 25R and engaging the detents 31. The split ring 32 is then closed to secure the mandrels in place.

Once the loaded mandrels are in place and the split ring 32 is closed, the cylinder 58 is energized in the reverse direction to appropriately relatively position the assemblies 20, 22. Assuming the bagger has a supply of bags and an end one of that supply is positioned at the load station, the machine is now ready for cycling.

To commence a machine cycle, the air cylinder 124 is energized to move the upper one of the arms 108 from its FIG. 6 to its FIG. 8 position. In the meantime, the vacuum supply 158 has been energized so that the head 112 on the upper arm 108 will pickup the first end disc 130. Thereupon, the cylinder 124 and the upper arm 108 are returned from the FIG. 8 to the FIG. 6 position.

The actuator 100 is energized to rotate 180° from its disc pickup to its disc delivery location where the first disc is identified as a transferred disc 144. Next, the pickup head control solenoid valve 162 operates in response to a signal from one of the proxmity switches 152, 154 to terminate the drawing of a vacuum from what is now the lower pickup head 112 and cause a burst of air from the air pressure supply 160 to detach the first disc 144 from the head. The first disc then drops into a positioned and waiting bag 148.

Concurrently, as the transferred disc 144 is being released and dropped into the bag 148, the arm positioning cylinder 124 is cycling to cause the now upper arm 108 to pickup a second disc of the set 33. As will be apparent, the second disc is now the end one of the discs 130.

As soon as the first disc has been dropped and the second picked up, the actuator 100 is energized to return to its original position through 180° rotation in the opposite direction. Once the actuator has returned to its original position, the second disc is dropped into a second bag and a third disc is picked up by the same arm which picked up the first disc. Thereupon the entire cycle repeats until a first set of discs at the dispensing location 34 has been exhausted.

A signal from the electric eye 131 indicating there is no end disc in the dispensing location causes the retraction cylinder 58 to be energized and move the turret assembly 20 rearwardly. Once the turret assembly 20 has been fully retracted and a signal emitted by the position indicating proximity switch 60, the Geneva motion motor 37 is energized for one revolution.

Referring to FIG. 5, assuming the Geneva motor 37 causes a Geneva drive plate 168 to rotate in a counter clockwise direction as seen in FIG. 5, an indexing pin 170 will cause the star wheel 36 to rotate 60° clockwise in a well known manner. This indexing motion moves the emptied mandrel 30 at the dispensing location to the eight o'clock position as viewed in FIG. 5, while the mandrel and disc set at the four o'clock position in FIG. 5 are moved to the dispensing location.

The positioning air cylinder 58 is now energized to return the turret assembly 20 to its dispensing location and the transfer assembly is cycled until a second set of discs has been discharged and packaged.

At this juncture the indexing operation is repeated, a third set of discs are discharged and packaged and so on until all six disc sets 33 have been dispensed. Once all six disc sets are dispensed the total machine cycle has been completed and the turret assembly 22 will again be moved to its retracted position to begin another machine cycle.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. In a packaging machine an improved system for sequentially supplying flat, apertured discs one at a time to a packaging station, the system comprising:

a) a turret mounted for rotation about a rotation axis at an acute angle of the order of 10° with the horizontal;

b) a plurality of mandrels secured to and projecting orthogonally from the turret, each of the mandrels having an axis paralleling the rotation axis;

c) indexing means operably connected to the turret for rotating the turret and indexing the mandrels sequentially and one at a time into a dispensing location;

d) a disc biaser operably connected to the turret for urging a set of discs on a mandrel in the dispensing station away from the turret; and, e) a disc transfer mechanism connected to the turret for removing discs sequentially and one at a time from a mandrel in the dispensing station and transferring the discs to the packaging location.

2. The system of claim 1 wherein the mechanism comprises a rotatable pickup arm having two vacuum pickup end portions.

3. The system of claim 2 including means to interrupt a vacuum supply and provide a burst of air to dispense a disc.

4. The system of claim 1 further including a friction clamp for clamping discs at the dispensing station whereby to limit disc transfer to the end one of such set of discs in the dispensing station.

5. The system of claim 1 wherein each of said mandrels when positioned in the dispensing station has an axis located below said rotation axis and in an imaginary vertical plane including said rotation axis.

6. The system of claim 1 wherein there is a prime mover interposed between the turret and the transfer mechanism for relatively moving the turret and transfer mechanism from one to the other of a disc dispensing position and an indexing position.

7. The system of claim 1 wherein the mandrels are removable.

8. In combination with the machine of claim 1, wherein the system of claim 1 is an assembly including a frame;

a transfer assembly mounted on the frame;

a positioning means interposed between the transfer assembly and the turret for relatively moving the transfer assembly and the turret between a disc dispensing position and an indexing position;

the transfer assembly being adapted to transfer end ones of a disc set in the dispensing station sequentially and one at a time to a bagging station.

9. The dispenser of claim 8 wherein the transfer assembly includes a rotatably mounted pair of arms each having a pickup head.

10. The system of claim 8 wherein the mandrels are removable.

11. The system of claim 1 wherein:

a) the turret includes a turret plate having a plurality of forwardly facing mandrel receiving recesses;

b) there are a like plurality of mandrels each having a base portion complementally disposed in an associated one of the recesses with each base being in a recess different than the remainder of the bases;

c) each mandrel includes a stem projecting orthogonally from the plate;

d) a plurality of pairs of detents, coacting with the mandrel bases to retain the mandrels in their associated recesses there being at least two detents associated and coacting with each mandrel base; and, e) structure connected to the plate and overlying each base to assist in maintaining the bases in their associated recesses.

12. The improvement of claim 11 wherein the structure is a split collar circumscribing the plate.

13. The system of claim 1, wherein the disc transfer mechanism comprises:

a) a rotatable hub having first and second registration positions;

b) a diametrically opposed pair of pickup arms carried by the hub;

c) the arms being moveable relative to the hub from a respective transfer position to a pickup position when the hub is in an associated respective one of the registration positions;

d) pickup enabling means for shifting each arm to its pickup position; and, e) each arm including a vacuum pickup for picking up a disc when in its pickup position and for transferring a disc each time the hub rotates from that arm's associated registration position to the other registration position.

14. The mechanism of claim 13, wherein a pair of proximity sensors are provided and respectively associated with the arms each sensor being for causing release of a transported disc each time its respective and associated arm reaches its said other registration position.

15. The system of claim 1, wherein the turret includes a turret plate having a plurality of forwardly facing mandrel receiving recesses, and wherein there are a like plurality of mandrels each having a base portion complementally disposed in an associated one of the recesses with each base being in a recess different than the remainder of the bases, and wherein there are a plurality of pairs of detents coacting with the mandrel bases to retain the mandrels in their associated recesses, there being at least two detents associated and coacting with each mandrel base, and structure connected to the plate and overlying each base to assist in maintaining the bases in their associated recesses.

16. The system of claim 15, wherein the structure is a split collar circumscribing the plate.

17. A method of packaging flat annular discs comprising:

a) mounting each set of a plurality of sets of discs on a different one of a plurality of mandrels each of the mandrels having an axis at an acute angle of the order of 10° with the horizontal and parallel to the other mandrel axes:

b) rotatively indexing a turret supporting the mandrels about an axis paralleling the mandrel axes to index the mandrels and their respectively supported disc sets sequentially and one at a time into a dispensing station;

c) biasing a disc set in the dispensing station away from the turret; and, d) sequentially and one at a time transferring end ones of a biased set from the dispensing station to a load station.

18. The method of claim 17 wherein the transfer step is accomplished with a vacuum pickup.

19. The method of claim 18 wherein each disc is released at the load station by a burst of air.

20. The method of claim 17 further including the step of clamping discs adjacent end ones whereby to retain the clamped discs on their mandrel as each of said end ones is removed.

* * * * *